US011344855B2

(12) United States Patent
Baron et al.

(10) Patent No.: US 11,344,855 B2
(45) Date of Patent: May 31, 2022

(54) MIXING CONTAINER AND METHOD OF USE

(71) Applicant: Vivex Biologies Group, Inc., Atlanta, GA (US)

(72) Inventors: Vanessa Baron, Southwest Ranches, FL (US); Shabnam Namin, Miami, FL (US)

(73) Assignee: Vivex Biologics Group, Inc., Atlanta, GA (US)

( * ) Notice: Subject to any disclaimer, the term of this patent is extended or adjusted under 35 U.S.C. 154(b) by 337 days.

(21) Appl. No.: 16/506,574

(22) Filed: Jul. 9, 2019

(65) Prior Publication Data

US 2021/0008511 A1 Jan. 14, 2021

(51) Int. Cl.

| | |
|---|---|
| ***B22C 5/00*** | (2006.01) |
| ***B01F 27/808*** | (2022.01) |
| ***B01F 27/091*** | (2022.01) |
| ***B01F 27/112*** | (2022.01) |
| ***B01F 27/072*** | (2022.01) |
| *B01F 27/213* | (2022.01) |

(Continued)

(52) U.S. Cl.

CPC ..... *B01F 27/808* (2022.01); *B01F 27/0724* (2022.01); *B01F 27/091* (2022.01); *B01F 27/112* (2022.01); *B01F 27/213* (2022.01); *B01F 35/33* (2022.01); *B01F 35/75425* (2022.01)

(58) Field of Classification Search

CPC ... B01F 7/00725; B01F 27/808; B01F 27/213
See application file for complete search history.

(56) References Cited

U.S. PATENT DOCUMENTS 4,197,943 A 4/1980 Weikel
5,265,956 A 11/1993 Nelson et al.

(Continued)

FOREIGN PATENT DOCUMENTS

CN 106419405 2/2017
DE 29922445 U1 * 4/2000 ..... B01F 15/00681
WO WO-2017208028 A1 * 12/2017 ..... B01F 7/30

OTHER PUBLICATIONS

DE29922445U1 machine translation of the description (Year: 2000).*

(Continued)

*Primary Examiner* — Anshu Bhatia
*Assistant Examiner* — Gregory Y Huan
(74) *Attorney, Agent, or Firm* — David L. King

(57) ABSTRACT

A mixing container with an internal mixing blade has an extraction funnel, a main housing, a rotatable base cap, a mixing blade and a gear mechanism. The extraction funnel has a first end with a maximum diameter and narrowing to a second end of a minimum diameter at a neck portion. The main housing includes a mixing chamber. The rotatable base cap with an internal gear is attached to and is rotatable relative to the main housing. The mixing blade has a plurality of prongs extending from a shaft. The prongs are in the mixing chamber and the shaft extends through an opening in the main housing to inside the rotatable base cap. The gear mechanism has at least one gear, each of the at least one gears is connected to or intermeshed with the internal gear of the base cap and the gear of the shaft end.

12 Claims, 11 Drawing Sheets

(51) Int. Cl.
*B01F 35/33* (2022.01)
*B01F 35/75* (2022.01)

(56) References Cited

U.S. PATENT DOCUMENTS

| | | | | |
|---|---|---|---|---|
| 5,344,232 | A | 9/1994 | Nelson et al. | |
| 5,395,167 | A | 3/1995 | Murray | |
| 5,415,474 | A | 5/1995 | Nelson et al. | |
| 5,494,349 | A | 2/1996 | Seddon | |
| 6,702,455 | B2 * | 3/2004 | Vendrely | B01F 13/002 366/130 |
| 6,719,451 | B1 | 4/2004 | Yue | |
| 9,259,696 | B2 | 2/2016 | Globerman et al. | |
| 9,572,458 | B2 * | 2/2017 | Conti | B01F 27/0725 |
| 2014/0245900 | A1 * | 9/2014 | Conti | A47J 43/0722 99/348 |
| 2014/0269152 | A1 * | 9/2014 | Venot | B01F 35/3202 366/129 |
| 2015/0374175 | A1 * | 12/2015 | Garr | B01F 33/50111 366/314 |
| 2017/0274332 | A1 * | 9/2017 | Gandhi | B01F 27/213 |

OTHER PUBLICATIONS

DE29922445U1 machine translation of the claims (Year: 2000).*
U.S. Pat. No. 642,650 (A)—Feb. 6, 1900 Walker et al ; Churn.

* cited by examiner

MIXING CONTAINER AND METHOD OF USE

FIELD OF THE INVENTION

The present invention relates to a mixing container and methods of using. The mixing container has a mixing blade in a mixing chamber for uniformly blending dry compositions with fluids. Optionally, and more specifically, the mixing container forms a package container to be pre-filled with a dry composition upon assembly, stored and shipped for later use.

BACKGROUND OF THE INVENTION

Mixing devices are well known and are commonly used in food preparation. Often a variety of dry ingredients like flour or cake mixes must be mixed with fluids such as water, milk, egg, etc. In such cases, the methods involve using handheld mixers with rotatable blades or mixing bowls. The objective is to quickly and easily blend the combination of ingredients into a uniformly dispersed batter, so the finished product is a perfectly baked cake.

In medical and scientific research applications, the constituents of the ingredients also involves a mixing of dry compositions with fluids. In many cases, the outcomes of this blending depends on uniform dispersion, avoidance of waste and in the case of incorporating viable cells or biological active cell components this mixing must avoid damage. In many medical applications, the surgical personnel are asked, in an aseptic and non-contaminating way, to mix these constituents in the operating room, often with no suitable way to do the task, let alone to make a uniform blend without damaging the components. The spillage, waste and damage means the material that is to be implanted or injected into the patient varies in quality and therefore effectiveness. This quality of mixed ingredients varies widely dependent on the skill of the personnel doing the blending.

The objective of the present invention is to create a mixing container that eliminates all these possible technique dependent variations and provides the medial or research staff a sterile self-contained mixing chamber isolated from any external contamination. These and other beneficial objectives are achieved by the present invention described herein.

SUMMARY OF THE INVENTION

A mixing container with an internal mixing blade has an extraction funnel, a main housing, a rotatable base, a mixing blade and a gear mechanism. The extraction funnel has a first end with a maximum diameter and narrowing to a second end of a minimum diameter at a neck portion. The main housing includes a mixing chamber. The rotatable base with an internal gear is attached to and is rotatable relative to the main housing. The mixing blade has a plurality of prongs extending from a shaft. The prongs are in the mixing chamber and the shaft extends through an opening in the main housing to inside the rotatable base. An end of the shaft has a gear. The gear mechanism has at least one gear, each of the at least one gears is connected to or intermeshed with the internal gear of the rotatable base and the gear of the shaft end. The gear mechanism is external of the mixing chamber and is held in the rotatable base cap. Rotation of the rotatable base drives the gear mechanism to rotate the mixing blade.

The shaft of the mixing blade has an axis of rotation centered and aligned with the axis of rotation of the rotatable base. The rotatable base has the internal gear extending circumferentially and is coupled to the at least one gear to form a planetary gear system about the gear of the shaft of the mixing device. Each of the at least one drive gears are larger than the gear of the shaft and rotation of the rotatable base spins the mixing blade faster than the speed of the rotatable base, preferably at least four times faster, preferably about five times faster. The main housing is detachable from the rotatable base.

In one embodiment, the main housing is snap fit attached to a circumferentially continuous groove of the rotatable base and removably attached and rotatable about the groove of the rotatable base. The mixing blade is sealed at the shaft to the main housing by an "O" ring seal at the opening, optionally by two "O" ring seals.

The mixing container further has a sealed injection port affixed at the second end of the neck portion of the extraction funnel. The sealed injection port can be in a cap. The cap can be removably attached to the second end of the extraction funnel. The gear mechanism of the mixing container includes a 36 tooth rotatable base gear, a 36 tooth at least one gear and a 16 tooth gear at the end of the mixing shaft.

In one embodiment, the mixing chamber and extraction funnel are made of clear or transparent plastic. The rotatable base, mixing blade and gears are made of non-transparent plastic. The "O" ring seal or seals and injection port are made of an elastomeric material, the elastomeric material can be a natural or synthetic rubber.

In one embodiment, the rotatable base has an external raised grip surface around the periphery of the rotatable base adjacent to the external raised grips of the main housing to facilitate rotation of the rotatable base relative to the main housing and the main housing has an external raised grip surface molded into the main housing around a periphery of the main housing to hold the main housing while the rotatable base is rotated. The extraction funnel is attached to the end of the main housing by a threaded fastening. The mixing chamber of the main housing has a concave conical bottom and the prongs of the mixing blade extend internally adjacent along the conical bottom and turn parallel and adjacent to closely fit along an internal cylindrical surface of the mixing chamber.

The device of the present invention can be used by the following method. The method of mixing a composition has the steps of: providing a mixing container with a main housing with a mixing chamber with an internal mixing blade rotatable by a gear mechanism with a plurality of gears in a rotatable base of the mixing container, the mixing container having a quantity of dried micronized particles inside the mixing chamber, the mixing chamber having an end attached to an extraction funnel, the extraction funnel having a first end with a maximum diameter and narrowing to a minimum diameter at a neck portion at a second end, and the neck portion at the second end having a sealed injection port; injecting a volume of fluid using a needle with a syringe attached through the sealed injection port into the extraction funnel and mixing chamber containing the micronized particles; and rotating the base of the mixing container to move the plurality of gears of the gear mechanism to spin the internal mixing blade to incorporate the fluid into the micronized particles to the wet composition.

The method further has the steps of: inverting the mixing container; inserting a needle with an empty syringe attached into the injection port; and extracting the wet composition into the syringe.

The method further has the steps of: inserting a needle with a syringe attached into the injection port, the syringe having a quantity of cells or cell components; pushing the cells or cell components into the into the extraction funnel and mixing chamber with the wet composition; and rotating the base of the mixing container to move the plurality of gears of the gear mechanism to spin the internal mixing blade to disperse and incorporate the cells or cell components into the wet composition.

The method further has the steps of: inverting the mixing container; inserting a needle with an empty syringe attached into the injection port; and extracting the wet composition and cells or cell components into the syringe.

The method further has the step of: injecting or implanting the wet composition in the syringe into a patient.

The method further has the step of: injecting or implanting the wet composition with cells or cell components into a patient.

The dried composition can be shipped in the mixing container at the manufacture or can be added to an empty mixing container by removing the extraction funnel, adding the dried composition into the mixing chamber and placing the extraction funnel back onto the main housing.

In an alternative method, the mixing container can be used to make a high viscosity material such as a bone gel, paste or putty, with or without cells or cell components, or a disc composition, or made from dried nucleus pulposus micronized particles with or without cells, or a neural composition made from dried neural tissue micronized particles. The mixing occurs similarly, but the container when inverted allowing the extraction funnel to be detached with the mixed composition or be directly removed with or without syringes if so desired. Alternatively, the extraction funnel can be removed without inverting the mixing container and the composition can be removed with or without syringes from the mixing chamber.

BRIEF DESCRIPTION OF THE DRAWINGS

The invention will be described by way of example and with reference to the accompanying drawings in which:

FIG. 9A shows a mixing container pre-filled with a dry micronized particle composition wherein a syringe holding a volume of a fluid has an attached needle inserted into an injection port and wetting the composition.

FIG. 9B shows the wetted composition being mixed by the mixing blade moving in a clockwise and/or counter-clockwise rotation by twisting a rotatable base until the fluid and composition are fully mixed.

FIG. 9C shows a second syringe filled with cells or cell components being injected into the mixing container and the wetted composition.

FIG. 9D shows the combination of cells or cell components being incorporated into the wetted composition by the movement of the mixing blade driven by the gear mechanism in the rotatable base.

FIG. 9E illustrates the step of inverting the mixing container twisting the rotatable base to rotate the mixing blade moving the wetted composition with or without the cells or cell components into an extraction funnel with an empty syringe with needle shown for later extraction.

FIG. 9F illustrates the syringe with a needle of FIG. 9E inserted into the injection port of the inverted mixing container as a withdrawal movement of the syringe plunger extracts the contents of the mixing container into the syringe.

DETAILED DESCRIPTION OF THE INVENTION

With reference to FIGS. 1-8, illustrations of the mixing container of the present invention are shown.

Figure 1:
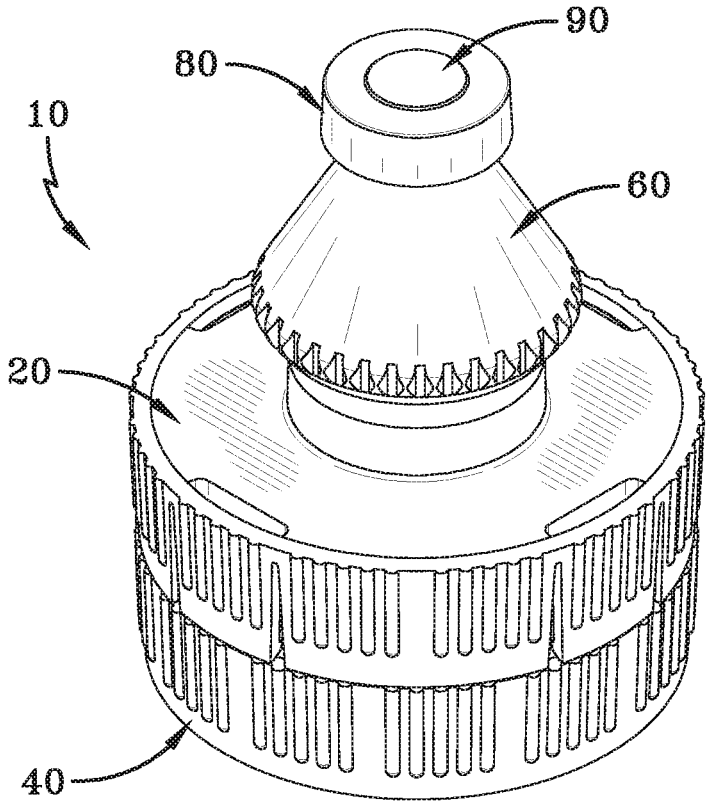
FIG. 1 is an upper perspective view of the mixing container of the present invention.
Figure 2:
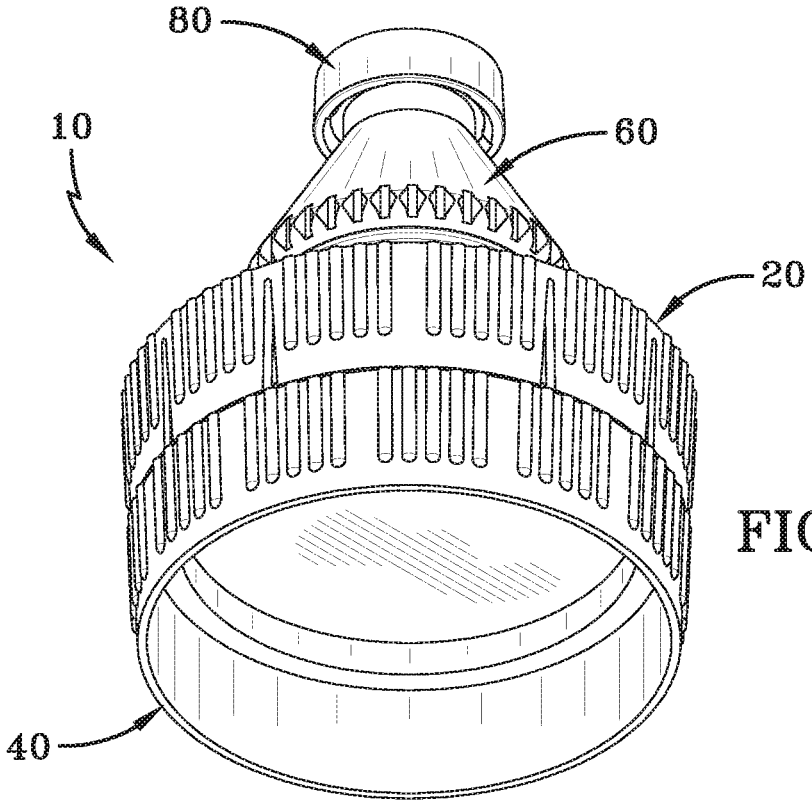
FIG. 2 is a lower perspective view of the mixing container of FIG. 1.
Figure 3:
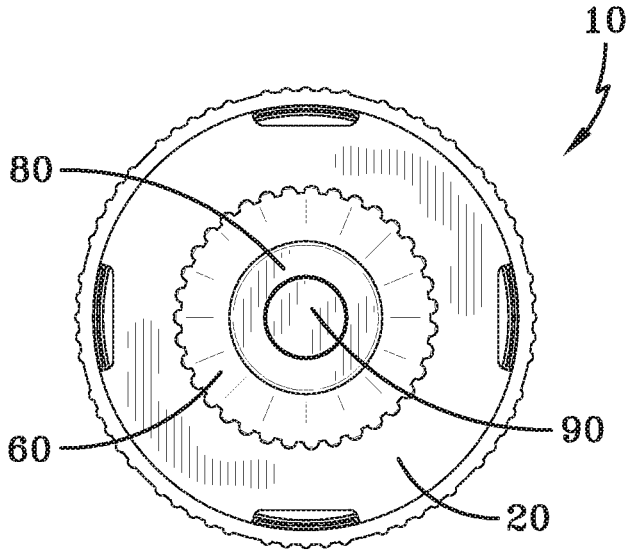
FIG. 3 is a top plan view of the mixing container of FIG. 1.
Figure 4:
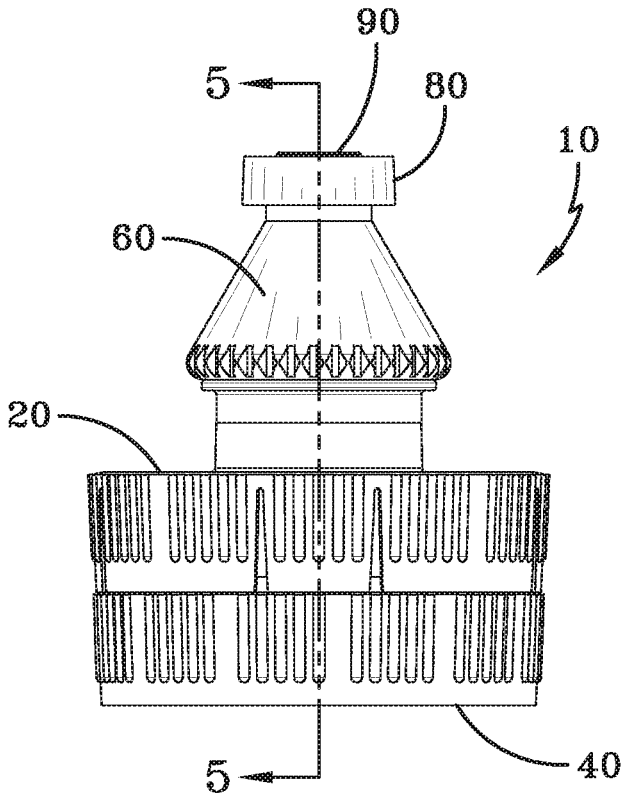
FIG. 4 is a side plan view of the mixing container of FIG. 1.
Figure 11:
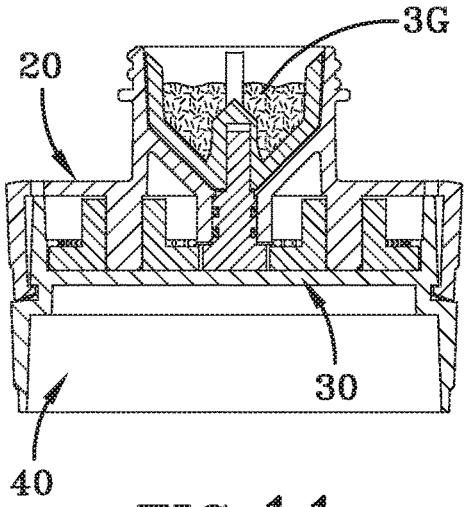
FIG. 11 shows a mixing container filled with a dry micronized particle composition at a point of use.

With reference to FIGS. 1-4, the mixing container 10 of the present invention is illustrated. FIG. 1 is an upper perspective view. FIG. 2 is a lower perspective view. In these views, the lowest portion is a rotatable base 40. The rotatable base 40 is attached to a main housing 20, affixed to the main housing 20 is an extraction funnel 60. The extraction funnel 60 has a maximum diameter at its connection to the main housing 20 and narrows to a second end, the second end having a cap 80 housing an injection port 90 as illustrated. The mixing container 10 is a unique device in that it is designed to be pre-filled with a dry component or composition. It is optimally filled at the manufacturing site or can be filled at the point of use with the dry component. One of its primary uses is to hold a micronized particle or other dry component. The dry component can be a bone based allograft material or a nucleus pulposus freeze-dried material, a neural tissue that has been freeze-dried and micronized into particles, or can even include demineralized bone particles or fibers in a dried form. In these forms, the dry component or composition is packaged in the mixing chamber best illustrated in FIG. 9A. The mixing chamber 24 has a conical base and a cylindrical chamber with a threaded end and is part of the main housing 20. The dry components are poured into this mixing chamber 24 when the extraction funnel 60 is removed as shown in FIG. 11.

Figure 5:
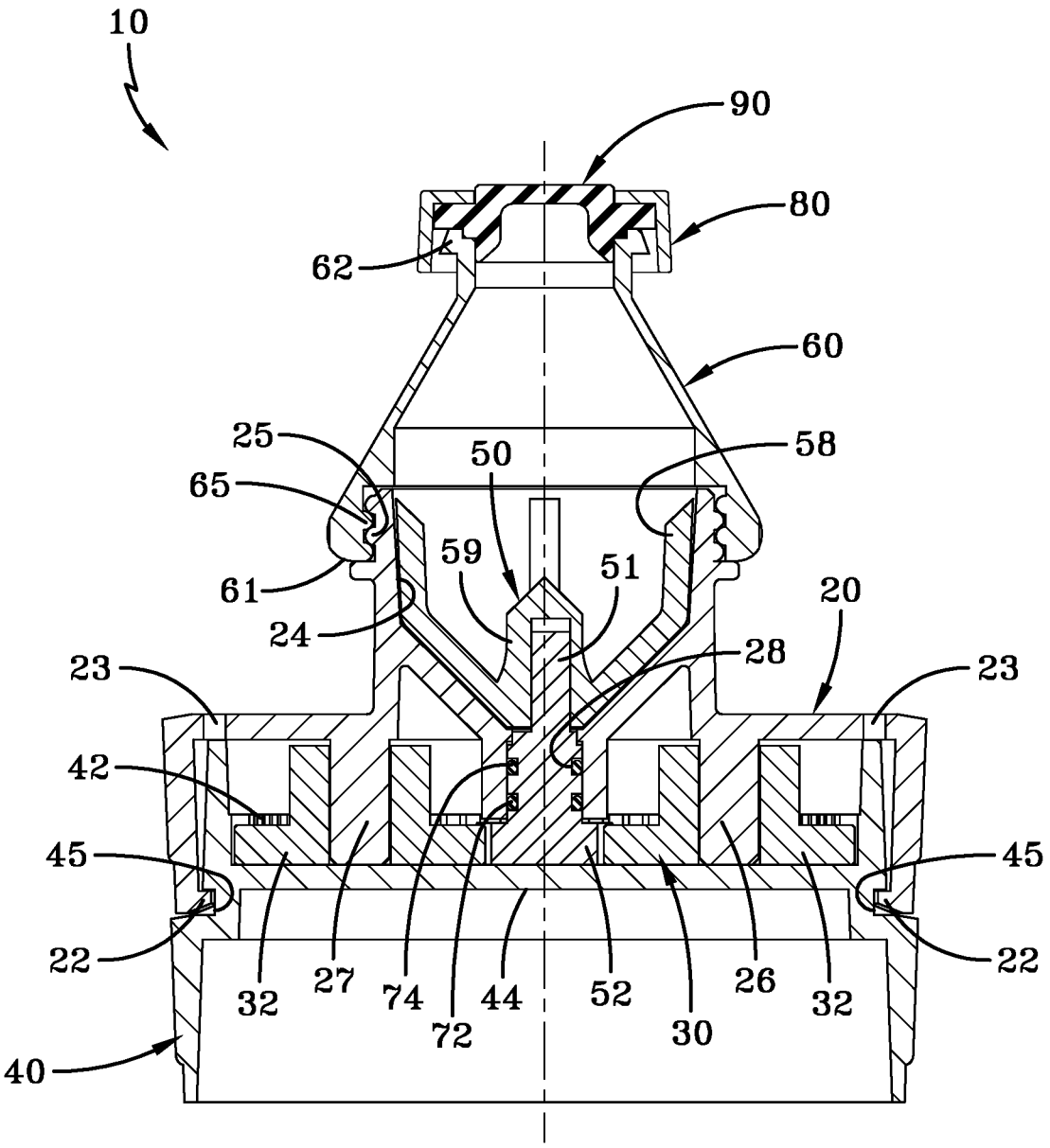
FIG. 5 is a cross sectional view of the mixing container taken along lines 5-5 of FIG. 4.

As shown in FIG. 5, the extraction funnel 60 is threaded onto the mixing chamber 24 column using the threads 25 of the column and the threads 65 of the extraction funnel 60. When the dry component is placed into the mixing chamber 24, it is placed onto a mixing blade 50 that is internally housed in the mixing chamber 24. The mixing blade 50 has a plurality of prongs 58. These prongs 58 extend from a central hub 59 and follow the contour of the internal surface of the mixing chamber 24 and extend internally adjacent along the conical bottom and turn parallel and adjacent to an internal surface of the cylindrical chamber in the mixing chamber as clearly illustrated in FIG. 5. The mixing chamber 24 when filled has the extraction funnel 60 screwed back onto the top making a connection or seal. In one embodiment, this is done at the manufacturing site. The mixing container with the dry component 3D can then be placed in separate packaging for shipment and delivery that can be opened at the point of use or alternatively, can be packaged without any external covering, however, it is believe important the injection port at least be covered with some type of removable seal, not shown, if not placed in a sterile package. The purpose of sterility is that this mixing container 10 will be delivered to a surgical suite wherein the material in its dry form will be reconstituted into a flowable form as will be discussed in FIGS. 9A-9F.

Figure 12:
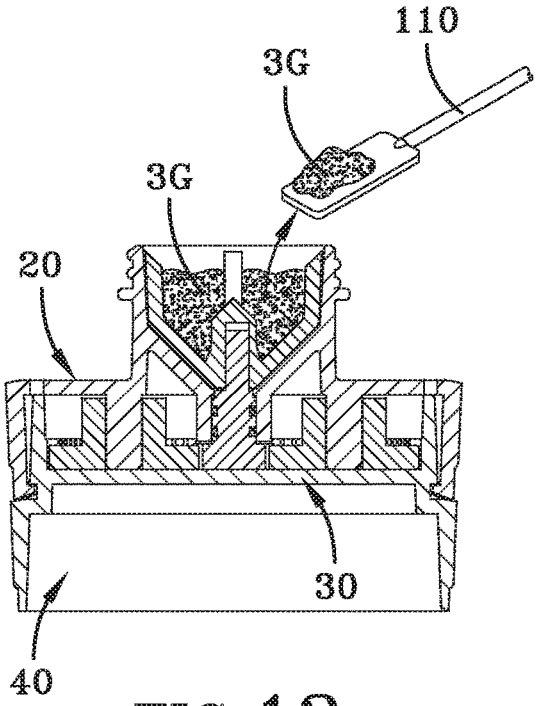
FIG. 12 shows the mixing container with the extraction funnel removed to allow removal of a wetted composition.

Alternatively, an empty mixing container 10 can be filled with the dry component at the point of use by removing the extraction funnel 60 and pouring the dry component 3D into the mixing chamber 24. Once filled, the extraction funnel 60 is replaced back onto the mixing chamber 24 and mixing can occur as shown in FIGS. 9A-9D. The thoroughly mixed composition 3C can be withdrawn from the mixing container 10 as shown in FIGS. 9E and 9F; or alternatively, the gel composition 3G can be removed as shown in FIG. 12.

Figure 6:
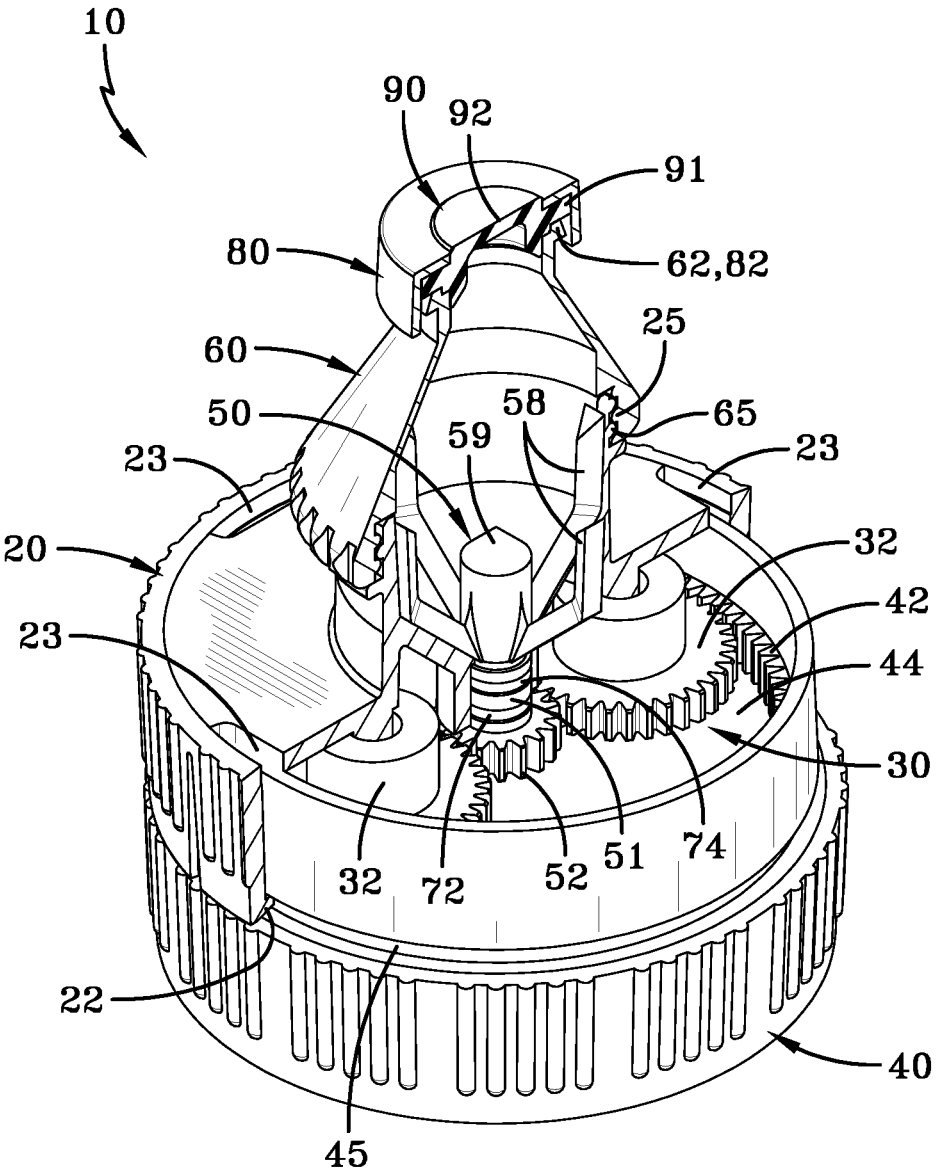
FIG. 6 is a partial cutaway view of the mixing container wherein an upper portion of the mixing container is removed exposing the mixing blade and gear mechanism.
Figure 7:
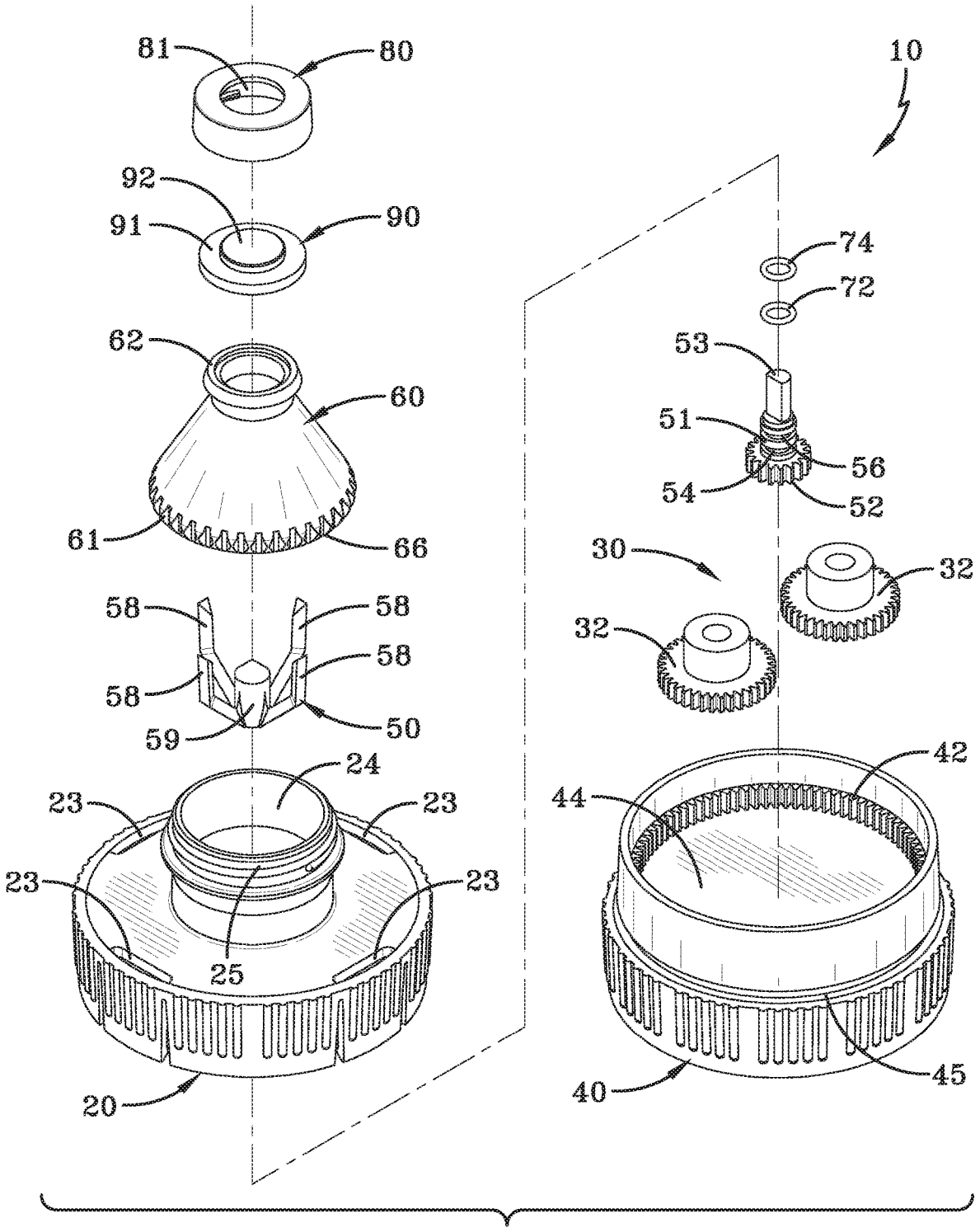
FIG. 7 is an exploded upper perspective view of the mixing container of FIG. 1.
Figure 8:
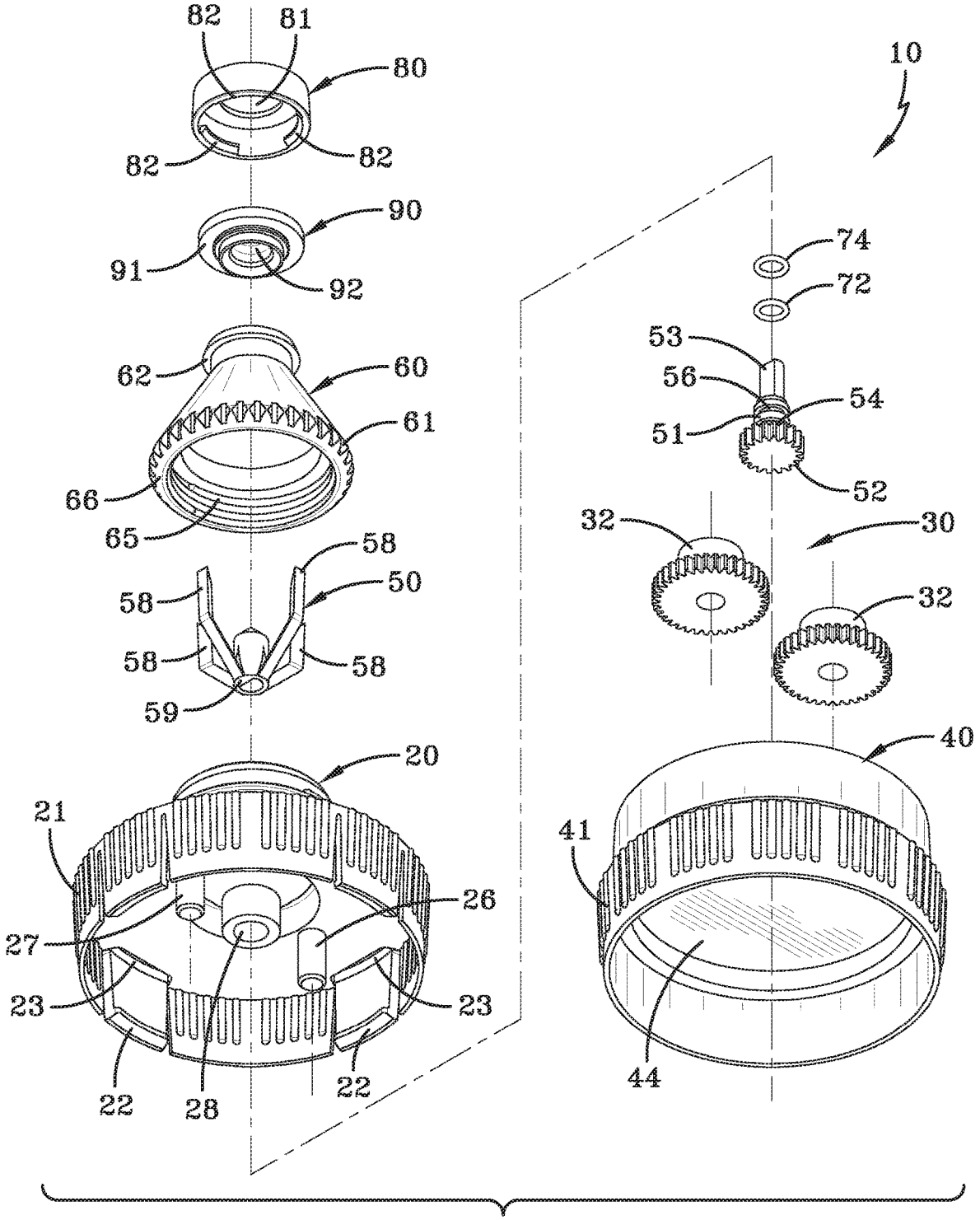
FIG. 8 is an exploded lower view of the mixing container of FIG. 2.

In order for the container to be used at the surgical suite for preparation of an implantation to be prepared for use on a patient, the mixing container 10 has the base 40 rotatable relative to the main housing 20, the rotation of the rotatable base 40 drives a gear mechanism 30. The gear mechanism 30 has a plurality of gears driven by the rotatable base 40. Inside the rotatable base 40 is flat top 44 with a circumferentially extending continuously ring or an base internal gear 42 above the top, this base internal gear 42 drives a pair of inner gears 32 as illustrated, the inner gears 32 intermesh with the outer base internal gear 42 and rotate driving a gear 52 connected to a shaft 51 holding the mixing blade 50. The gears 32 and 52 all rest on the top 44 as shown in FIG. 6. In FIGS. 7 and 8, the entire gear mechanism 30 is shown in an exploded view. The pair of gears 32 are above the base internal gear 42 and the gear 52 at an end of the shaft 51 above the pair of gears 32. The shaft 51 has a pair of grooves 54, 56 about which a pair of "O" rings 72, 74 are attached. These "O" rings seal the shaft 51 relative to the main housing opening 28 through which the shaft 51 extends. The shaft 51 has a proximal end that is a hemispherical shape that has a flat portion 53. The flat portion 53 fits into a complimentary opening of a central hub 59 of the mixing blade 50 in such a fashion that it provides a non-rotatable coupling between the shaft 51 and the mixing blade 50. When the rotatable base 40 is rotated, the base internal gear 42 moves and is intermeshed with the gears 32, the gears 32 consequently rotate and drive the gear 52 on the shaft 51 to move the mixing blade 50 rotatingly. This movement can occur either clockwise or counterclockwise and can be done in a twisting action to gently agitate the contents inside the mixing chamber 24.

As further illustrated, the main housing 20 portion snap fits onto the rotatable base 40 at a groove 45. The groove 45 is connected to the main housing 20 via a projection 22 on a flexible tab. The flexible tab is adjacent an opening or slot 23 in the main housing 20 as illustrated in FIG. 5. It must be remembered that these attachments are such that the main housing 20 can be attached or detached from the rotatable base 40 by flexing the plurality of tabs around the circumference of the main housing 20. As illustrated, there are four of these flexible tabs about the outer periphery of the main housing 20. As further illustrated, the gears 32 each have a central opening, the central opening fits over posts 26, 27 projecting from the main housing 20. The posts 26, 27 are circular in such a way that the gears 32 can rotate about these posts 26, 27 freely, as best illustrated in FIG. 5.

Another important aspect of the present invention is that the mixing chamber 24, has a cylindrical column with a large cylindrical opening that extends to a conical bottom. The conical bottom has an opening 28 that is completely sealed from the external atmosphere by the seals 72, 74 of the shaft 51 and by the extraction funnel 60 which is threadingly engaged onto the top of the mixing chamber 24 of the main housing 20. Additionally, at the attachment, a plurality of projections are shown around the maximum diameter of the extraction funnel 60. These are provided so the user, if so desired, can simply unthread the extraction funnel 60 to open the mixing container 10. This feature is quite beneficial in certain aspects, as will be discussed. Additionally, the main housing 20 portion has a plurality of grips or depressions 21 molded into the main housing 20 structure. As illustrated all the components of the mixing container 10 can be made of plastic with the exception of an injection port 90 and the seals 72, 74 which can be made of a synthetic elastomer or natural rubber. The grips 21 around the periphery of the main housing 20 and the similar grips 41 around the rotatable base are provided so the user can hold onto these grips 21, 41 to easily move the rotatable base 40 relative to the main housing 20. The main housing 20 and all its components will remain stationary as the rotatable base 40 moves the gears which in turn moves the mixing blade 50 to stir the contents of the mixing chamber 24.

As shown in FIGS. 6-8, the elastomeric injection port 90 has a center portion 92 that projects slightly upwardly about an external flange 91 that fits onto the neck end of the extraction funnel 60. The cap 80 is then snap fit onto the neck end as shown in the illustration of FIG. 6. The neck end has an annular ring 62 that projects outwardly and the cap 80 is pressed over that ring 62 and has a plurality of projections 82 that engage and snap on the ring 62 making a sealed system. The extraction funnel 60 has grips 61 at the wide end 66 opposite the neck end and ring 62 as best shown in FIGS. 7 and 8.

Figure 9A:
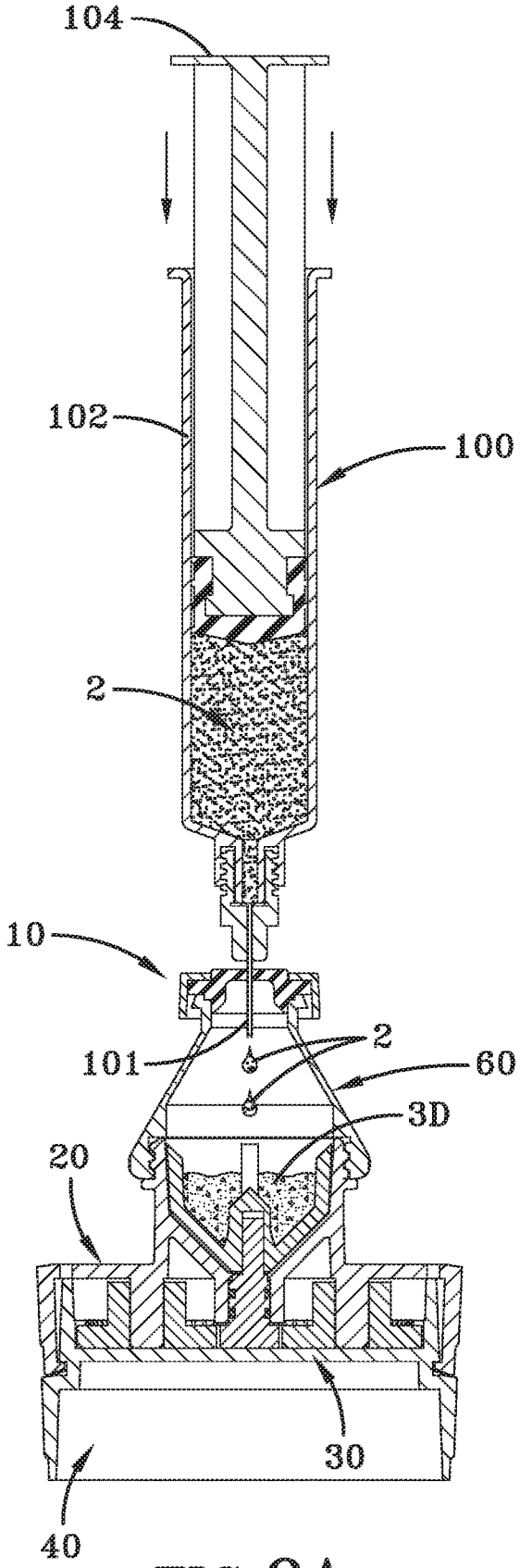
FIGS. 9A-9F illustrate an exemplary method of how the mixing container is to be used with all the views shown in cross section.
Figure 9B:
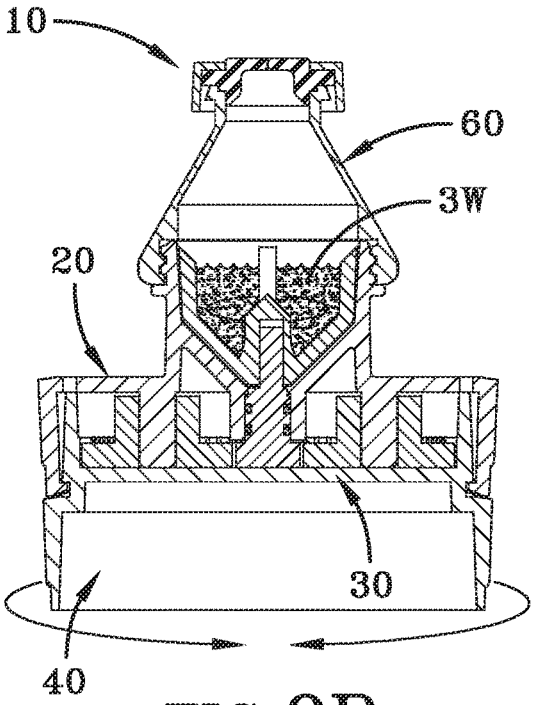
Figure 9C:
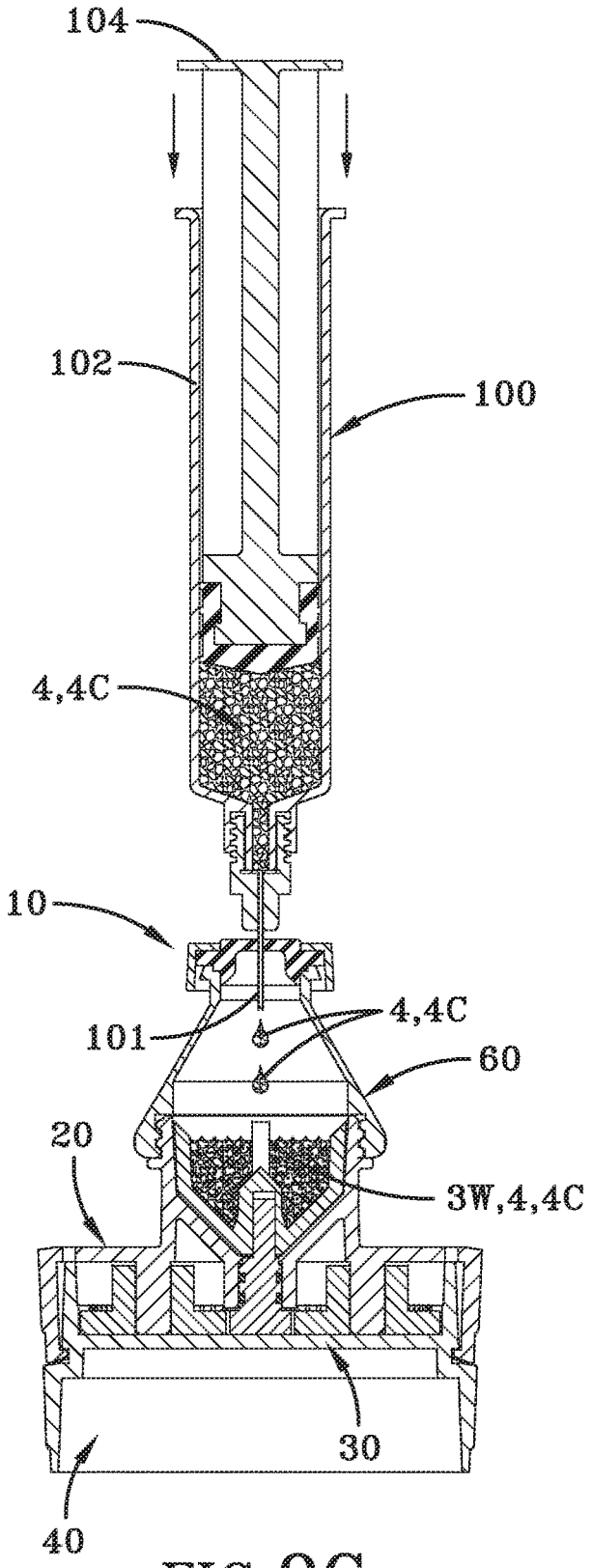
Figure 9D:
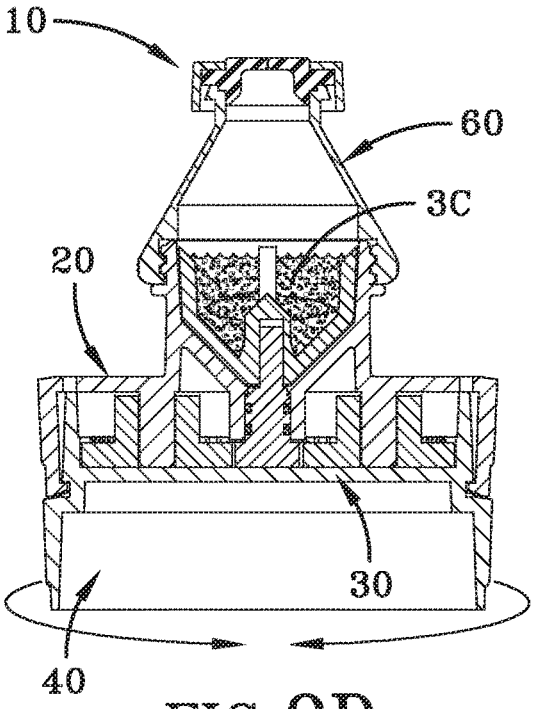
Figure 9E:
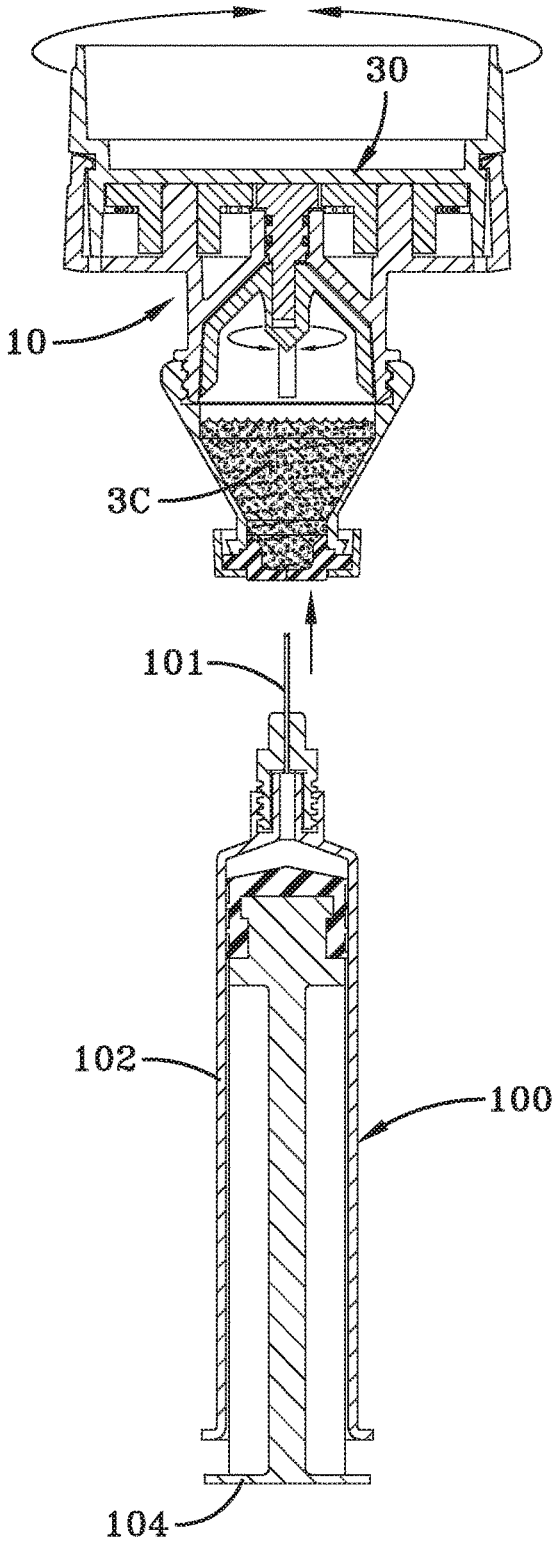
Figure 9F:
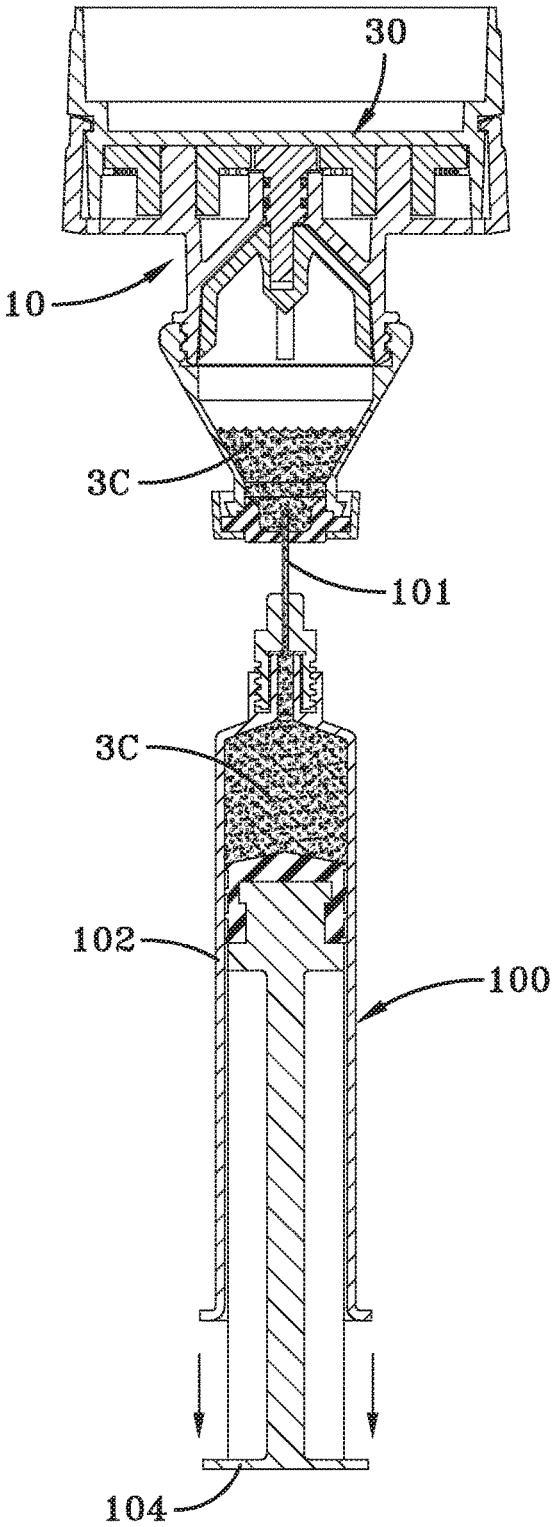

With reference to FIGS. 9A-9F and FIG. 10, the mixing container 10 provides a unique way in which a dry micronized particle composition 3D can be stowed in the mixing chamber 24 and, as shown in FIG. 9A, a fluid filled syringe 100 with a needle 101 attached that can be inserted through the injection port 90 in such a way to transfer the fluid 2 from the syringe 100 into the mixing chamber 24 by pushing the plunger 104 inwardly filling the chamber 24 with a desired quantity of fluid 2 to achieve a desired viscosity of a wet composition 3W.

FIG. 9B shows the fluid 2 after being added to the previously dry composition 3D is blended or mixed uniformly by rotation of the rotatable base 40 relative to the main housing 20 to form the wetted composition 3W. This rotation of the rotatable base 40 drives the gear mechanism 30 which causes the mixing blade 50 to rotate internal of the mixing chamber 24. This rotation is illustrated by the directional arrows that shows the rotation can be a twisting action back and forth such that agitation occurs that uniformly disperses the fluid 2 within the mixing container 10.

Figure 10:
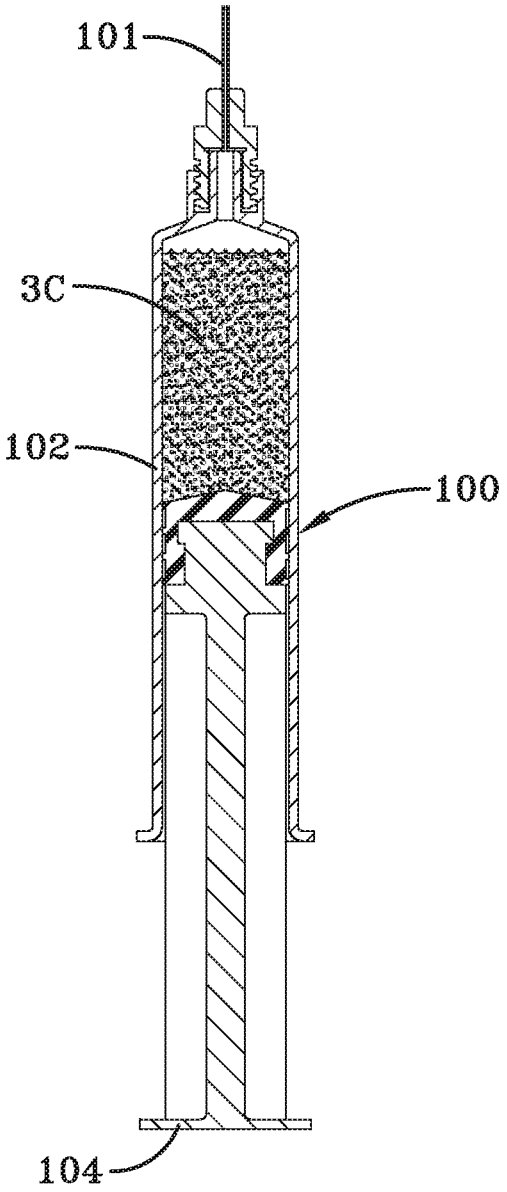
FIG. 10 illustrates the contents of the mixing container after being transferred into the syringe ready for use by implantation or direct injection.

At this point, if the wetted composition 3W is ready for use and is such that a paste or bone gel or some other viscous material composition 3G is created, then as shown in FIG. 12, the contents of this gel of viscous composition 3G can be taken from either the extraction funnel 60 by inverting the entire assembly mixing container 10 or by rotating the mixing blade 50 such that all the paste and gel like material falls into the extraction funnel 60. Once all the material is in the extraction funnel 60, the extraction funnel 60 can be unscrewed from the mixing container 10 and the material can be removed with a spatula or other means 110, or as shown in FIG. 12, the paste or gel composition 3G can be left in the mixing chamber 24 and removed with a spatula 110 once the extraction funnel 60 is detached. This is particularly useful in bone cements or other material where the paste or gel like material needs to be taken out using the spatula 110 or other means so it can be used to fill a bone defect. This is important in that many materials are of such viscosity that they will not easily pass through a needle. However, in many cases in the operating room, there is a need for a composition such that the dried components 3D when mixed with the fluid 2 are sufficiently small enough that they will easily pass through a needle into a syringe. As illustrated in FIGS. 9B-9F and 10, once the composition is wetted sufficiently with fluid 2 from a first syringe 100, as shown in the procedures of 9A and 9B, then a second syringe 100 filled with cells 4 or cell components 4C can be injected into the wetted composition 3W in the mixing chamber 24, as shown in FIG. 9C. As shown in FIG. 9C, cells 4 or cell components 4C housed in a syringe body 102, are injected through the needle 101 inserted in the injection port 90 into the mixture 3W in the mixing chamber 24 of the mixing container 10 as the plunger 104 is pushed to add the cells 4 or cell components 4C in liquid form to the wetted composition 3W. As shown in FIG. 9D, the wetted composition 3W and cells 4 or cell components 4C are uniformly mixed in the mixing container 10 forming a mixture or composition with cells 3C using rotation of the rotatable base 40 as previously discussed. At this point, the mixing container 10 is inverted so the thoroughly mixed contents 3C flow to the extraction funnel 60. An empty syringe 100 is then inserted into the injection port 90 and the plunger 104 is pulled back, as illustrated in FIGS. 9E and 9F, transferring the contents of the mixing container 10 to the syringe 100 as shown in FIG. 10. At this point, the mixture 3C with cells 4 or cell components 4C thoroughly dispersed in mixing container 10 and transferred to the syringe and can be used for direct injection into a patient or for implantation into a patient using the filled syringe 100.

Uniquely, the mixing blade 50 by being contoured to the internal surface of the mixing chamber 24 allows the cells 4 or cell components 4C to be gently agitated so the composition 3W is uniformly dispersed with the cells 4 or cell components 4C. This is particularly important when handling viable cells or biologically active materials in such a fashion that very little damage occurs and maximum dispersion and uniformity can be achieved. Historically, the surgical team when preparing these components will take cells that may have been cryogenically frozen, warm the container so the cells are now in a fluid form and then try to handle the material in such way that it can be transferred for use with the patient. This can be tedious and difficult to mix dry compositions with viable cells in a fluid and not damage or cause harm or contamination of the material to be injected in the patient. These problems are fundamentally eliminated with the use of a sterile syringe and needle assembly and the mixing container with injection port. These features make it easy for the practitioners to, in a self-contained way, mix the contents without allowing the contents to ever be exposed to the external atmosphere. Preferably, before insertion into the injection port occurs, one will swab the external surface of the injection port to ensure it is sterile upon entry of the sterile needle 101. Once the fluids are added to the mixing container and the composition is thoroughly mixed and dispersed, the composition can be withdrawn safely and aseptically into a sterile syringe for direct implantation or injection into a patient.

Heretofore, the ability of cells to be handled in a uniform and consistent way has not been possible, therefore, often the use of cells has varying degrees of success depending on the experience of the surgical team in their preparation of the material for injection or implantation into the patient. With the present invention, these variables are virtually eliminated in that everything can be done in a self-contained way. Simply by twisting the rotatable base one can achieve a uniform dispersion of the materials after they have been inserted into the mixing container 10 in such a way that is difficult to not effectively achieve the desired uniformity and dispersion. A simple few twists of the rotatable base 40 causes the mixing blade 50 to move rapidly due to a preferential gear ratio arrangement such that movement of the outer ring in short rotation caused a more rapid movement of the blade substantially quicker allowing the material to be mixed gently and uniformly. The movement of the blade is sufficiently fast to cause a dispersion and yet sufficiently gentle so it does not damage the cells.

The current invention can be used with a variety of either natural or synthetic materials for the dry components 3D that can be made at the manufacturing plant. These dry materials 3D can include by way of example, a variety of ether synthetic compositions, microbeads or calcium triphosphate or other materials used in bone repair, or bone allografts that can be fibers, micronized or particularized, micronized nucleus pulposus or micronized neural tissue. All of these components heretofore have been provided in separate packages and must be manipulated and assembled at the surgical suite. Such products, while very beneficial to the patient, need to be uniformly and consistently prepared. The present invention achieves this result in a way that is both sterile, aseptic and minimizes any loss or risk of loss.

It is important to note that while the extraction funnel is shown with an injection port, in certain cases where bone gels or paste is being made, the injection port may be unnecessary, in such a case, the extraction can have a closed end, not shown, so that the funnel is a one piece structure that can be threaded onto the mixing chamber 24. In these cases, the dry components can be reconstituted to the desired viscosity level and used in that fashion, as illustrated in FIGS. 11 and 12. With that possibility, other variations can be made, for example, the injection port can be removable, if so desired, and can be threadingly engaged onto the narrow end of the extraction funnel. In such a case, a large diameter syringe could be inserted through the opening and material could be inserted or withdrawn with or without a very large gauge large diameter lumen needle. Other variations are possible with the present invention making it very useful piece of equipment to be used at the surgical site.

As illustrated all the components can be made of a synthetic plastic, injection molded in such a way that one use, the entire mixing container assembly can be discarded and not reused. Alternatively, the mixing container could be made of materials that can be sterilized and reused such as stainless steel, however, the objective of the present invention is to have the mixing container disposable. These and other variations can be achieved without altering from the spirit and scope of the present invention.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A mixing container with an internal mixing blade comprises:

an extraction funnel having a threaded first end with a maximum diameter and narrowing to a second end of a minimum diameter at a neck portion;

a main housing with a mixing chamber, the mixing chamber configured to receive a volume of dry components in the mixing chamber, the mixing chamber having a space to hold the dry components in having a concave conical bottom and a cylindrical chamber with a threaded end configured to receive the threaded first end of the extraction funnel, the main housing having external raised grips molded into the main housing around a periphery of the main housing opposite the threaded end of the cylindrical chamber;

a rotatable base with an internal gear attached to and rotatable relative to the main housing, the rotatable base being adjacent to the main housing and having external raised grips around the periphery of the rotatable base adjacent to the external raised grips of the main housing to facilitate rotation of the rotatable base relative to the main housing, wherein the main housing is detachable from the rotatable base, the main housing being snap fit attached to a circumferentially continuous groove of the rotatable base and removably attached and rotatable about the groove of the rotatable base, wherein the main housing is detachable from the rotatable base, the main housing having a plurality of flexible tabs, each flexible tab being adjacent a slot opening, each flexible tab having a projection configured to be snap fit attached to the circumferentially continuous groove of the rotatable base and removably attached and rotatable about the groove of the rotatable base;

a mixing blade, the mixing blade having a plurality of prongs extending from a shaft, the plurality of prongs follow the internal contour of the mixing chamber and extend internally adjacent along the conical bottom and turn parallel and adjacent to an internal surface of the cylindrical chamber in the mixing chamber and the shaft extending through an opening in the main housing to inside the rotatable base, an end of the shaft having a gear;

a gear mechanism having a at least one gear, each of the at least one gears being connected to or intermeshed with the internal gear of the base and the gear of the shaft end, the gear mechanism being external of the mixing chamber and in the rotatable base; and wherein holding the external grips of the rotatable base while rotating the rotatable base while holding the main housing about the external raised grips of the main housing drives the gear mechanism to rotate the mixing blade inside the mixing chamber.

2. The mixing container of claim 1 wherein the shaft of the mixing blade has an axis of rotation centered and aligned with the axis of rotation of the rotatable base.

3. The mixing container of claim 2 wherein the rotatable base has the internal gear extending circumferentially and is coupled to the at least one gear to form a planetary gear system about the gear of the shaft of the mixing device.

4. The mixing container of claim 3 wherein each of the at least one gears are larger than the gear of the shaft and rotation of the rotatable base spins the mixing blade faster than the speed of the rotatable base, about four times faster.

5. The mixing container of claim 1 wherein the mixing blade is sealed at the shaft to the main housing by an "O" ring seal at the opening.

6. The mixing container of claim 1 further comprises: a sealed injection port affixed at the second end at the neck portion of the extraction funnel.

7. The mixing container of claim 6 wherein the sealed injection port is in a cap, the cap being removably attached to the second end of the extraction funnel.

8. The mixing container of claim 1 wherein the gears include a 36 tooth rotatable base gear, a 36 tooth at least one gear and a 16 tooth gear at the end of the mixing shaft.

9. The mixing container of claim 1 wherein the mixing chamber is made of clear or transparent plastic.

10. The mixing container of claim 1 wherein the rotatable base, mixing blade and gears are made of plastic.

11. The mixing container of claim 6 wherein an "O" ring seal and the sealed injection port are made of an elastomeric material.

12. The mixing container of claim 11 wherein the elastomeric material is a natural or synthetic rubber.

* * * * *